US007836712B2

(12) United States Patent
Sasao et al.

(10) Patent No.: US 7,836,712 B2
(45) Date of Patent: Nov. 23, 2010

(54) AIR CONDITIONING APPARATUS

(75) Inventors: Keiji Sasao, Kasumigaura (JP); Tadakatsu Nakajima, Kasumigaura (JP)

(73) Assignee: Hitachi, Ltd., Tokyo (JP)

( * ) Notice: Subject to any disclaimer, the term of this patent is extended or adjusted under 35 U.S.C. 154(b) by 1074 days.

(21) Appl. No.: 11/528,653

(22) Filed: Sep. 28, 2006

(65) Prior Publication Data

US 2007/0107450 A1 May 17, 2007

(30) Foreign Application Priority Data

Nov. 16, 2005 (JP) ..... 2005-331031

(51) Int. Cl.
*F25B 49/00* (2006.01)

(52) U.S. Cl. ..... 62/176.6; 62/185; 236/44 C

(58) Field of Classification Search ..... 62/176.1, 62/185, 201; 236/44 A, 44 C
See application file for complete search history.

(56) References Cited

U.S. PATENT DOCUMENTS

| | | | | |
|---|---|---|---|---|
| 6,223,543 | B1 * | 5/2001 | Sandelman | 62/93 |
| 6,269,650 | B1 * | 8/2001 | Shaw | 62/176.6 |
| 2008/0116289 | A1 * | 5/2008 | Lochtefeld | 237/81 |

FOREIGN PATENT DOCUMENTS

| | | |
|---|---|---|
| JP | 57-120042 | 7/1982 |
| JP | 05-296532 | 11/1993 |
| JP | 6-101894 | 4/1994 |
| JP | 2002-213795 | 7/2002 |
| JP | 2003-222378 | 8/2003 |
| JP | 2004-053127 | 2/2004 |
| JP | 2004-316980 | 11/2004 |
| JP | 2005-37106 | 2/2005 |
| JP | 2005-308313 | 11/2005 |

OTHER PUBLICATIONS

Official Action issued is Japanese Patent Application No. 2005-331031 on May 25, 2010.

* cited by examiner

*Primary Examiner*—Marc E Norman
(74) *Attorney, Agent, or Firm*—Antonelli, Terry, Stout & Kraus, LLP.

(57) ABSTRACT

An air conditioning apparatus comprises an air-conditioning unit including at least a cooling coil as a heat exchanger, a blower, a chiller, and a coolant pump for conducting air-conditioning, wherein the coolant pump pumps the coolant cooled by the chiller to the cooling coil, the cooling coil cools the air through heat exchange of the coolant and the air, the blower supplies the cooled air into a room. Coolant temperature of the chiller, the coolant flow rate of the coolant pump, and the air flow rate of the blower are calculated in accordance with the set points of the indoor temperature and the indoor humidity, and the chiller, coolant pump, and blower are controlled on the basis of the arithmetic calculation results. Thereby, the indoor temperature and indoor humidity are independently controlled in the central air-conditioning system.

13 Claims, 11 Drawing Sheets

AIR CONDITIONING APPARATUS

CLAIM OF PRIORITY

The present application claims priority from Japanese application serial JP 2005-331031 filed on Nov. 16, 2005, the content of which is hereby incorporated by reference into this application.

FIELD OF THE INVENTION

The present invention relates to an air conditioning apparatus and particularly to an air conditioning apparatus that it is possible to control temperature and humidity respectively independently according to sensible heat load and latent heat load.

In air conditioning for industrial use, precision control of temperature and humidity has been conducted from the view point of ensuring quality, for example, in a clean room for manufacturing of semiconductor devices. However, in air conditioning for business offices or home, humidity is often left to chance, although the temperature is controlled in accordance with the set point.

Amenity is strongly influenced by not only temperature but also humidity. For example, under high humidity ambient, even if temperature is adequately controlled, a person feels discomfort. Meanwhile, the ASHRAE(American Society of Heating, Refrigerating and Air-Conditioning Engineers) reports that influence of deleterious factors for health such as virus or mold can be purged by adjusting indoor relative humidity to 40% to 60%. As explained above, it is very important for not only comfort but also health to adjust temperature and humidity to the reasonably range through air conditioning.

Heretofore, when an air conditioning apparatus is comparatively large capacity system such as a central air-conditioning system for office buildings or a factory air-conditioning system, the following method has been often utilized as a method for individually controlling temperature and humidity. Namely, in this method, in taken air is once cooled and dehumidificated by a cooling coil and is thereafter reheated by are heating coil. FIG. 7 is a schematic system diagram showing an example of above method. An air-conditioning unit 1 comprises a cooling coil 2 and a reheating coil 10. The air taken in from the outdoor is mixed with the returned air 21 from the air-conditioning room 50, and the mixed air 22 is cooled and dehumidified with the cooling coil 2 and is thereafter heated with the reheating coil 10 and blown out to the air-conditioning room 50. To the cooling coil 2, a coolant such as chilled water cooled with a chiller 4 is supplied. Moreover,a heating medium such as hot water or vapor is supplied to the reheating coil 10 to heat the air.

The main reason for reheating the air cooled once with the cooling coil 2 with the reheating coil 10 is that it is required to adjust relative humidity of the supply air 23 to the predetermined value. Namely, because there is a case where the temperature of the air might fall in excess when a prescribed amount is dehumidified with coil 2, the air cooled in excess must be warmed by the reheating coil 10.

However, the method explained above not only allows increase in the load of the chiller 4 because of excessive cooling but also requires a heat source for reheating. Therefore, here rises a problem that useless energy is doubly consumed by cooling and reheating processes.

As a method for solving the problems in the related art, the patent document 1 discloses an air conditioning apparatus for using a part of the cooling water that rises temperature by condenser in chiller for reheating of the air, by supplying this cooling water to the reheating coil. Moreover, the patent document 2 discloses an air-conditioning control method that achieves the energy saving maintaining the comfort surroundings.

Patent document 1: Japanese Patent Laid-Open No. 2004-316980

Patent document 2: Japanese Patent Laid-Open No. 2002-213795

However, the related arts described above have the following problems.

A framework disclosed by the patent document 1 has a problem that the increase of the chiller load by an excessive cooling cannot be reduced, although a especially prepared heat source is not required for reheating. On the other hand, a framework of the patent document 2 assumes PMV (Predicted Mean Vote) to be an index and controls the air conditioning apparatus, but it controls only indoor temperature, and does not consider the method for adjusting humidity.

The cooling coil for cooling the in taken air is divided into a wet coil part where temperature of a coil surface is lower than the dew point temperature and the other part called a dry coil part. In the wet coil part, both heat and mass (steam) are transferred. Namely, since condensation of steam and lowering the temperature are dune simultaneously, both sensible heat load and the latent heat load can be removed simultaneously. Meanwhile in the dry coil part, since only the heat transfer is done, only the sensible heat load can be removed. Accordingly, if a ratio of the dry coil part to the wet coil part may be changed in accordance with a desired ratio of the sensible heat load to the latent heat load, temperature and humidity can be controlled independently without excessive cooling or reheating.

SUMMARY OF THE INVENTION

The present invention has been proposed considering the background explained above and it is therefore an object of the present invention to provide an air conditioning apparatus for independently controlling indoor temperature and indoor humidity using only one cooling coil by changing a ratio of the wet coil part to the dry coil part of the cooling coil in accordance with a rate of the sensible heat load and the latent heat load, namely an air conditioning apparatus for realizing temperature control without use of a reheating coil.

In view of achieving the object explained above, the present invention comprises the following technical means for providing an air conditioning apparatus for independently controlling temperature and humidity.

Namely, the air conditioning apparatus according to the present invention is principally characterized in comprising an air-conditioning unit including only a cooling coil as a heat exchanger, a blower, a chiller, and a coolant pump. In this air conditioning apparatus, the coolant pump pumps the coolant cooled by the chiller to the cooling coil, the cooling coil cools and dehumidifies the air through heat exchange between the coolant and the air, and the cooled air is supplied into a room by the blower for air-conditioning purposes. The air conditioning apparatus of the present invention is further characterized in comprising a controller for controlling coolant temperature of the chiller, the coolant flow rate of the coolant pump, and the air flow rate blown by the blower in accordance with the set points of temperature and humidity in the room.

Moreover, the air conditioning apparatus according to the present invention is characterized in comprising an outdoor air temperature sensor for sensing dry-bulb temperature of the outdoor air, an outdoor air humidity sensor for sensing humidity of the outdoor air, a indoor temperature sensor for sensing dry-bulb temperature of the air in the room, a indoor humidity sensor for sensing humidity of the air in the room, an arithmetic unit, and a controller, wherein the arithmetic unit calculates each set point of the coolant temperature of the chiller, the coolant flow rate of the coolant pump, and the air flow rate of the blower in order to respectively set a difference between the sensed value of the indoor temperature and the preset indoor temperature, and a difference between the sensed value of the indoor humidity and the preset indoor humidity to the predetermined values, while the controller controls coolant temperature of the chiller, the coolant flow rate of the coolant pump, and the air flow rate of the blower based on the each set point calculated by the arithmetic unit.

Here, the air-conditioning unit may be constituted so that only the cooling coil executes heat exchange during the cooling operation by providing at least a cooling coil as the heat exchanger.

Moreover, the air conditioning apparatus according to the present invention is characterized in realizing air-conditioning by executing heat exchange between the coolant, which is cooled by the chiller and pumped by the coolant pump, and the air thrown into the cooling coil, and then by supplying the cooled air into the room by the blower. The apparatus is characterized in further comprising a controller for controlling the coolant temperature of the chiller, the coolant flow rate pumped by the coolant pump, and the air flow rate of the blower in accordance with a rate of the sensible heat load and the latent heat load.

Moreover, the air conditioning apparatus of the present invention is characterized in comprising an outdoor air temperature sensor for sensing dry-bulb temperature of the outdoor air, an outdoor air humidity sensor for sensing humidity of the outdoor air, a indoor temperature sensor for sensing dry-bulb temperature of the air in the room, a indoor humidity sensor for sensing humidity of the air in the room, a supply air temperature sensor for sensing dry-bulb temperature of the air at the exit of the air-conditioning unit, a supply air humidity sensor for sensing humidity of the air at the exit of the air-conditioning unit, an arithmetic unit, and a controller. The arithmetic unit calculates the sensible heat load and the latent heat load from each measured value of the indoor temperature sensor, indoor humidity sensor, supply air temperature sensor and supply air humidity sensor, and calculates each set point of the coolant temperature of the chiller, the coolant flow rate of the coolant pump, and the air flow rate of the blower in order to respectively set a difference between the sensed value of the indoor temperature and the preset indoor temperature, and a difference between the sensed value of the indoor humidity and the preset indoor humidity to the predetermined values. The controller controls the coolant temperature of the chiller, the coolant flow rate of the coolant pump, and the air flow rate of the blower on the basis of the arithmetic calculation result of the arithmetic unit.

Here, it is also possible to adjust the coolant temperature of the chiller, the coolant flow rate pumped by the coolant pump, and the air flow rate of the blower on the basis of the calculation results which are calculated by the arithmetic and are displayed on the terminal equipment.

It is desirable to adjust the air flow rate by controlling in at least one method from among the 4 method of operating, the opening level control of a return air damper provided at a duct for guiding the return air from the room into the cooling coil, the opening level control of an outdoor air damper provided at a duct for guiding the outdoor air into the cooling coil, the opening level control of the supply air damper provided at a duct for guiding the air cooled by the cooling coil into the room, and frequency control of the blower.

Moreover, it is desirable to adjust the coolant flow rate to be pumped by controlling at least one of: the opening of a valve provided at a pipe for connecting the chiller and the cooling coil; and frequency of the coolant pump.

Moreover, it is desirable that the outdoor air humidity sensor, indoor humidity sensor, and supply air humidity sensor respectively measure any one of relative humidity, absolute humidity, dew point temperature, and wet-bulb temperature of the air.

Moreover, it is also possible for the arithmetic unit to comprise an operation means to calculate the amount of consumed energy of the air conditioning apparatus in order to calculate and output a optimum combination of the set points for minimizing the amount of consumed energy of the air conditioning apparatus chosen from among the combinations of the set points, with which both of the difference among the difference between the indoor temperature set beforehand and the measured indoor temperature, the indoor humidity set beforehand and the measured indoor humidity fill a prescribed value, of the coolant temperature of the chiller, the coolant flow rate pumped by the coolant pump, and the air flow rate of the blower.

The air conditioning apparatus of the present invention can provide a merit that increase in the chiller load can be prevented, because both indoor temperature and humidity can be adjusted respectively to the set points by heat exchange only in one cooling coil through adequate adjustment of the ratio of the dry coil part and wet coil part of the cooling coil, by controlling the temperature of the coolant supplied to the cooling coil, the coolant flow rate of the cooling coil, and the air flow rate of the blower.

Moreover, energy to be consumed by the air conditioning apparatus as a whole system can be saved through operation using a combination to minimize the amount of consumed energy among the combinations of each of the set points of the temperature of the coolant supplied to the cooling coil, the coolant flow rate to the cooling coil, and the air flow rate to be blown by the blower.

Moreover, the air conditioning apparatus of the present invention can also provide a merit that the reheating coil is not needed, because reheating process is not required and thereby the apparatus itself can be reduced in size.

DETAILED DESCRIPTION OF THE PREFERRED EMBODIMENTS

The preferred embodiments of the present invention will be explained below with reference to the accompanying drawings.

First Embodiment

Figure 1:
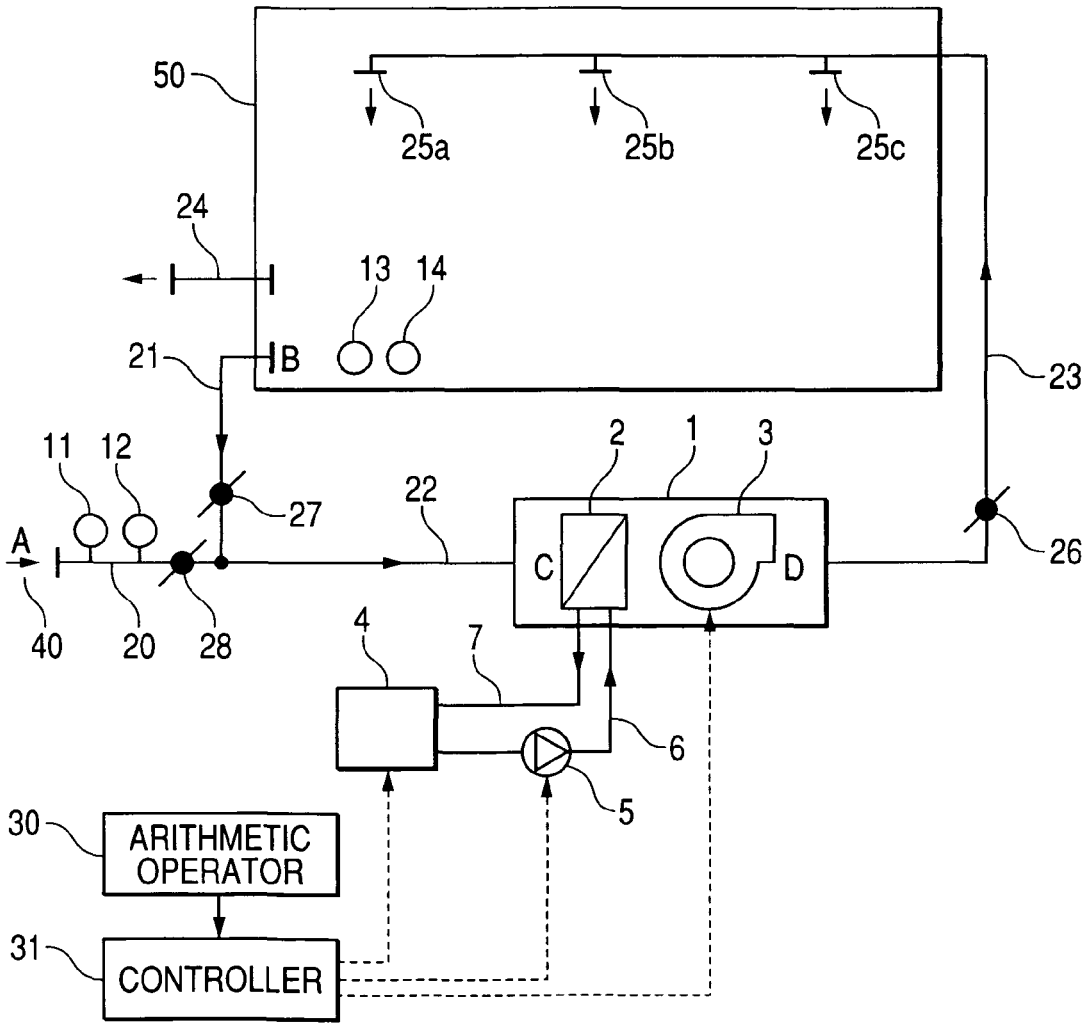
FIG. 1 is a block diagram showing a structure of an air conditioning apparatus.

FIG. 1 is a block diagram showing a structure of an air conditioning apparatus for explaining the first embodiment according to the present invention. The first embodiment shown in FIG. 1 is composed of a line for supplying air and a line for supplying chilled water as a coolant. The line for air is composed of an outdoor air duct 20 for taking outdoor air 40, an air returning duct 21 for returning the air from a room, an intake duct 22 for supplying outdoor air or return air to an air-conditioning unit 1 connected to the outdoor air duct 20 and the return air duct 21, the air-conditioning unit 1 comprising a cooling coil 2 and a blower 3, a supply air duct 23 for guiding air exhausted from the air-conditioning unit 1 into the room, a plurality of air supply openings 25 provided within the room, and an exhausting duct 24 for exhausting the air in the room to the outside thereof.

The outdoor air duct 20 includes an outdoor air damper 28, while the return air duct 21 includes a return air damper 27, and the supply air duct 23 includes a supply air damper 26. Moreover, for measuring of temperature and humidity, an outdoor air temperature sensor 11 and an outdoor air humidity sensor 12 are respectively provided in the outdoor air duct 20, while a indoor temperature sensor 13 and a indoor humidity sensor 14 are provided respectively within an air-conditioned area 50.

Meanwhile, the line for chilled water is sequentially connected to a chiller 4, a chilled water supplying pipe 6, the cooling coil 2, and a chilled water returning pipe 7. The chilled water supplying pipe 6 is constituted with inclusion of a chilled water pump 5 as a coolant pump for circulating the chilled water into the chiller 4, cooling coil 2 and each pipe.

Moreover, an arithmetic unit 30 and a controller 31 are also provided in addition to the lines for air and chilled water in order to control the air-conditioning unit or the like by extracting and analyzing the measured values of the outdoor air temperature, outdoor air humidity, indoor temperature and indoor humidity or the like.

The return air flowing from the room through the return air duct 21 and the outdoor air taken in through the outdoor air duct 20 are mixed by the ratio in accordance with the opening of the return air damper 27 and the outdoor air damper 28, and the mixed air flows into the cooling coil 2 through the intake duct 22. After the air that flows into the cooling coil 2 is cooled with the cooling coil 2, the air is supplied into the room from the air supply openings 25 through the blower 3 and the supply air duct 23. Moreover, the air in the same amount as the in taken outdoor air is then exhausted to the outside of the room by the exhausting duct 24.

On the other hand, the chilled water as a coolant is warmed with the cooling coil 2 through heat exchange with air and the warmed chilled water is then returned to the chiller 4 again through the chilled water returning pipe 7. Then the warmed chilled water is cooled by the chiller 4 to the predetermined temperature and is then supplied to the cooling coil 2 by the chilled water pump 5 through the chilled water supplying pipe 6.

Figure 8:
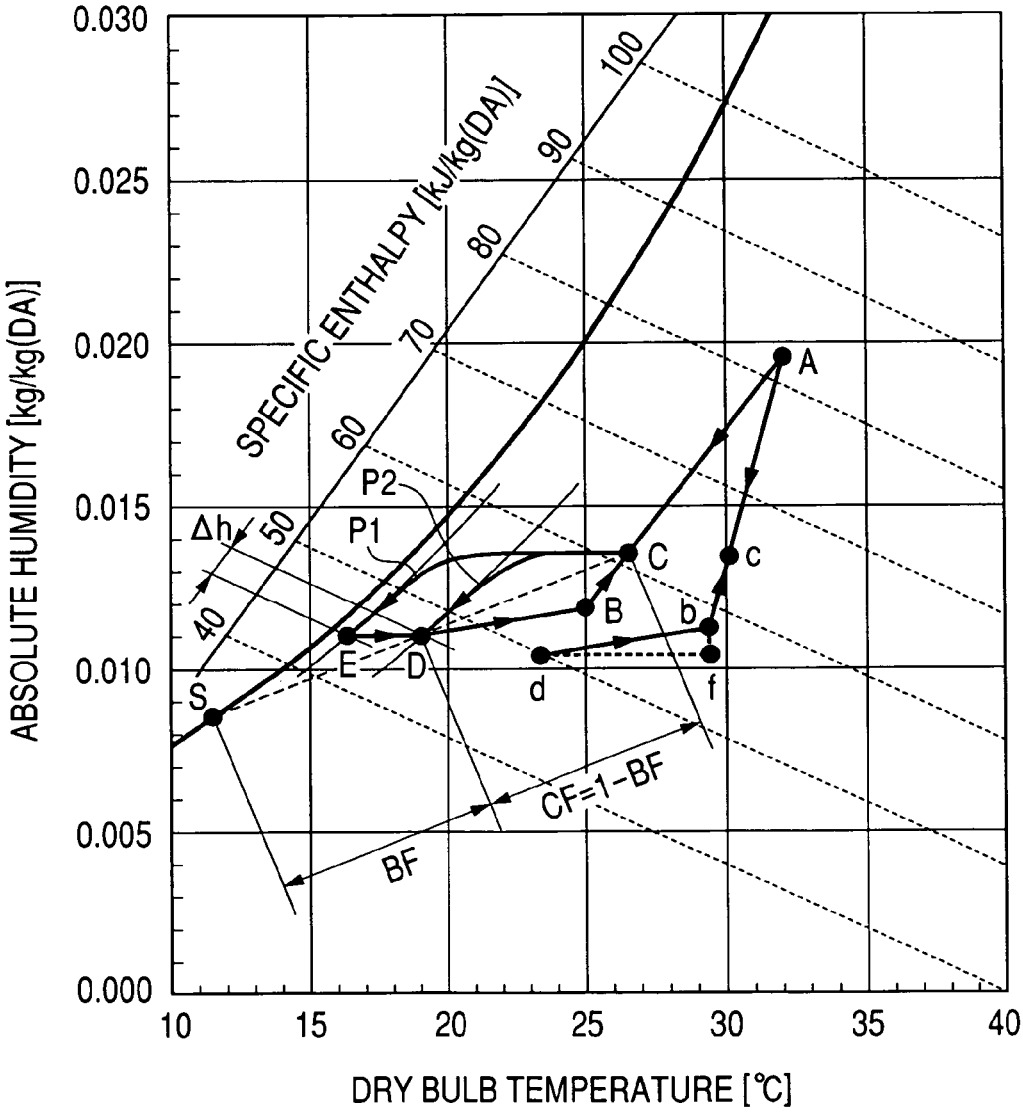
FIG. 8 is a graph showing a condition diagram of humid air conditioning.

Here, the state change of humid air will be explained by using with reference to FIG. 8. FIG. 8 is a humid air diagram where the dry-bulb temperature is plotted on the horizontal axis and the absolute humidity on the vertical axis. The operating state of the whole air conditioning system shown in FIG. 1 is illustrated on the humid air diagram. In FIG. 8, codes A to D respectively correspond to codes A to D in FIG. 1. Point C in FIG. 8 is a state point of the air at the entrance of the cooling coil 2, existing on the segment connecting the state point A of the in taken outdoor air and the state point B of the return air from the room. Point D is the state point of the air at the exit of the air-conditioning unit 1. Inclination of the segment BD is almost proportional to a ratio of the sensible heat load (rise in dry-bulb temperature) to the latent heat load (rise in the amount of steam) within the room. In the case that there is no latent heat load, the inclination is zero. Moreover, the larger the inclination of the segment BD becomes, the more the rate of the latent heat load for the total load (sum of the sensible heat load and the latent heat load) increases. Inclination of the segment BC is almost proportional to a ratio of the sensible heat load and the latent heat load of the outdoor air processing load. When synthesizing them, inclination of the segment DC is almost proportional to a ratio of the sensible heat load and the latent heat load of the total air-conditioning load including the load indoor and outdoor air processing load.

Figure 2:
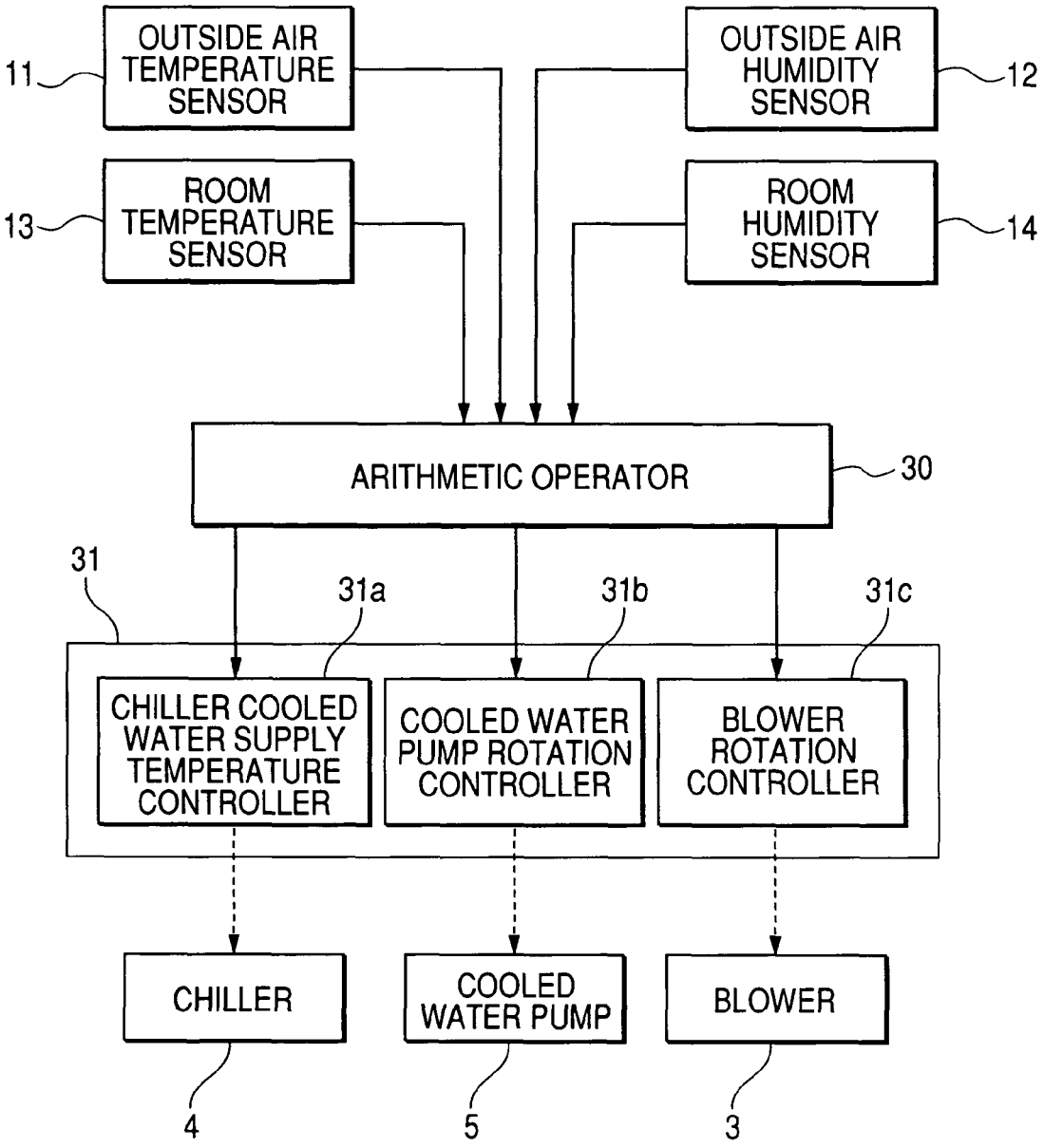
FIG. 2 is a control block diagram of the air conditioning apparatus.
Figure 3:
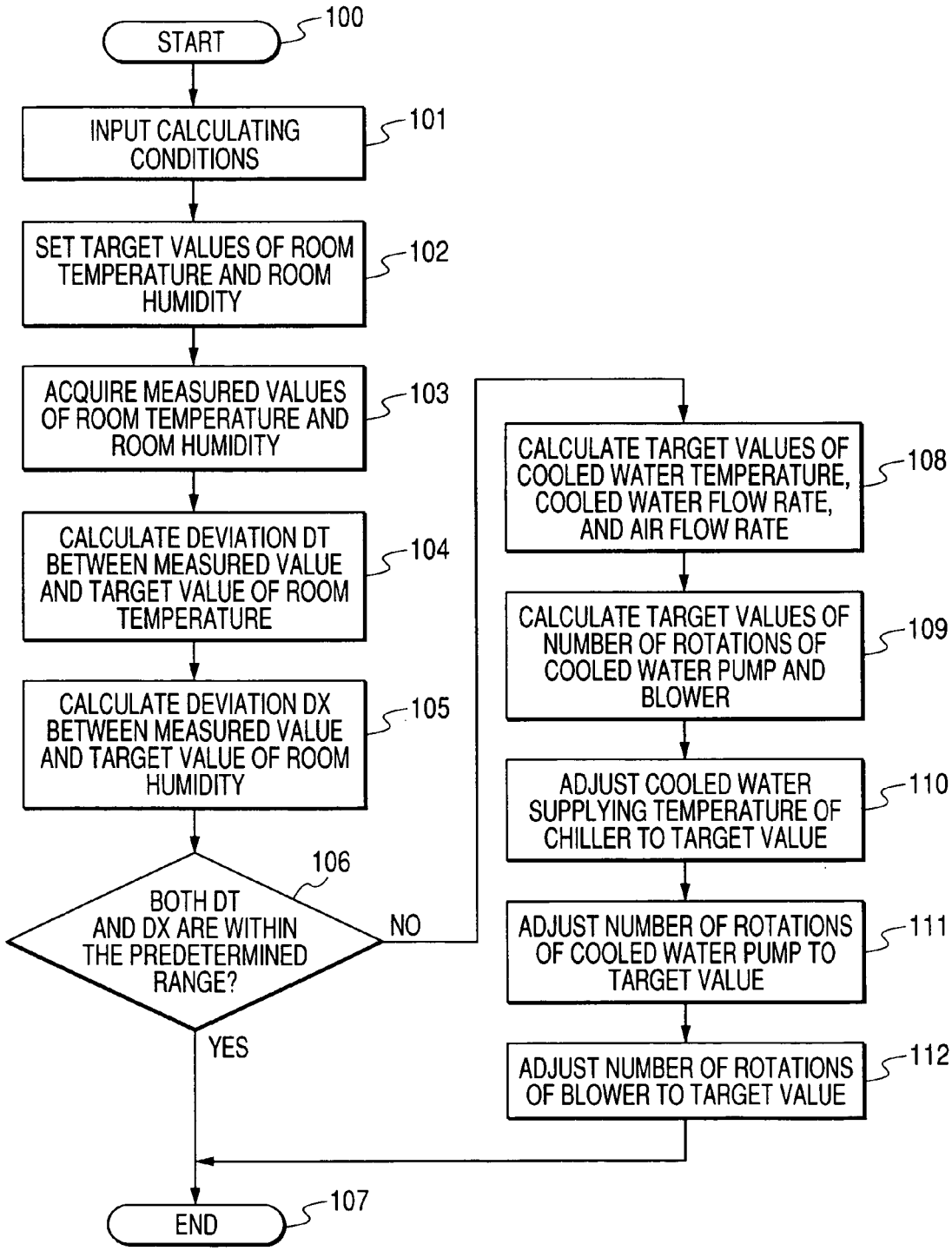
FIG. 3 is a flowchart showing control operations of the air conditioning apparatus.

Next, operations of the arithmetic unit 30 and controller 31 will be explained with reference to FIG. 2 and FIG. 3. FIG. 2 is a block diagram for explaining the first embodiment of the present invention and FIG. 3 is a flowchart for explaining operations of the present invention.

In the embodiment illustrated in FIG. 2, the arithmetic unit 30 calculates the set points of chilled water outlet temperature, the chilled water flow rate, and the air flow rate by extracting the measured values of each sensor such as the outdoor air sensor 11, outdoor air humidity sensor 12, indoor temperature sensor 13, and indoor humidity sensor 14 or the like, and then outputs the calculated results to the controller 31. The controller 31 comprises a chilled water outlet temperature of the chiller controller 31*a*, a chilled water pump frequency controller 31*b*, and a blower frequency controller 31*c*. The chilled water outlet temperature controller 31*a* outputs a control command to the chiller 4 in order to adjust the chilled water supply temperature of the chiller 4. Moreover, the chilled water pump frequency controller 31*b* outputs a control command to the chilled water pump 5 to adjust the chilled water flow rate by controlling frequency of the chilled water pump 5. Moreover, the blower frequency controller 31*c* outputs a control command to the blower 3 to adjust the air flow rate by controlling frequency of the blower 3.

Operation processing sequences of the arithmetic unit 30 and controller 31 will be explained below. When arithmetic operation starts, calculating conditions are inputted first (step 101). Here, the calculating conditions include, for example, shape and structural sizes of the cooling coil 2, adjustable upper and lower limit values of the chilled water outlet temperature, upper and lower limit values of frequency of the chilled water pump, upper and lower limit values of frequency of the blower, expression of correlation between the chilled water outlet temperature of chiller and the amount of consumed energy, expression of correlation between frequency of chilled water pump and the amount of consumed energy, and expression of correlation between frequency of blower and the amount of consumed energy, or the like. Next, the set point Ts of indoor temperature and the set point Xs of the indoor humidity are set (step 102). Subsequently, a measured value TRA of the indoor temperature sensor 13 and a measured value XRA of the indoor humidity sensor 14 are captured (step 103). Thereafter, a difference DT between the measured value TRA of the indoor temperature and the set point Ts, and a difference DX between the measured value XRA of the indoor humidity and the set point Xs are calculated respectively (steps 104, 105).

When the temperature difference DT and the humidity difference DX are both within the predetermined ranges, for example, DT is within the range of ±0.5° C. and DX is within the range of ±5% in terms of the relative humidity, the process is terminated, upon determination that both the indoor temperature and the humidity are adjusted to the set points. When at least one of DT and DX is out of the predetermined range, the set points of chilled water outlet temperature, the chilled water flow rate and the air flow rate are calculated for respectively adjusting the indoor temperature and the humidity toTs and Xs (step 108). In addition, the set point of frequency of the chilled water pump and the set point of frequency of the blower for adjusting the chilled water flow rate and the air flow rate are also. calculated (step 109). On the basis of the above calculation results, the chilled water outlet temperature of the chiller 4, frequency of the chilled water pump 5, and frequency of the blower 3 are controlled to respective set points (steps 110, 111, 112).

Figure 4:
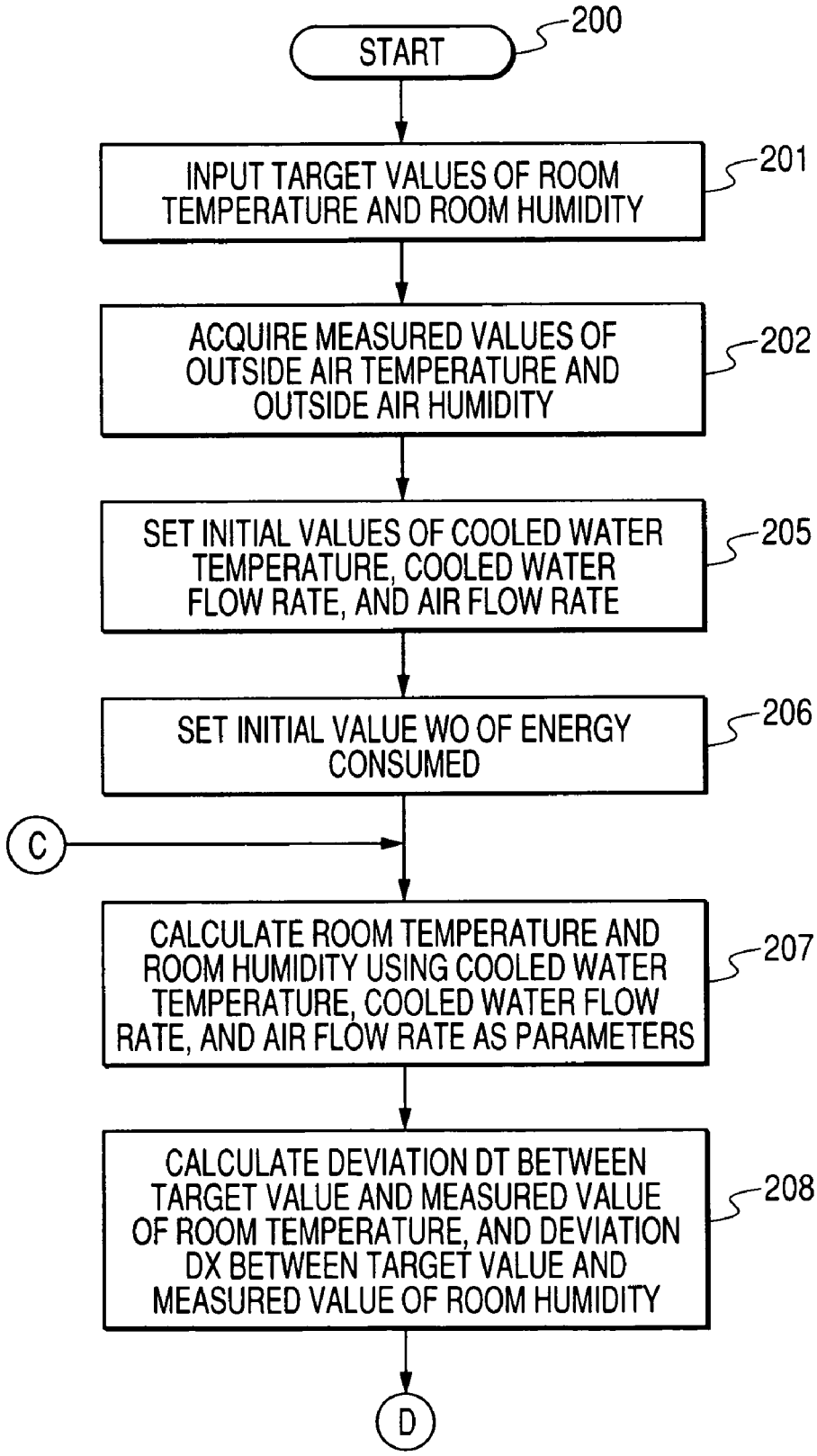
FIG. 4 is a flowchart showing a set point calculation processing sequence.
Figure 5:
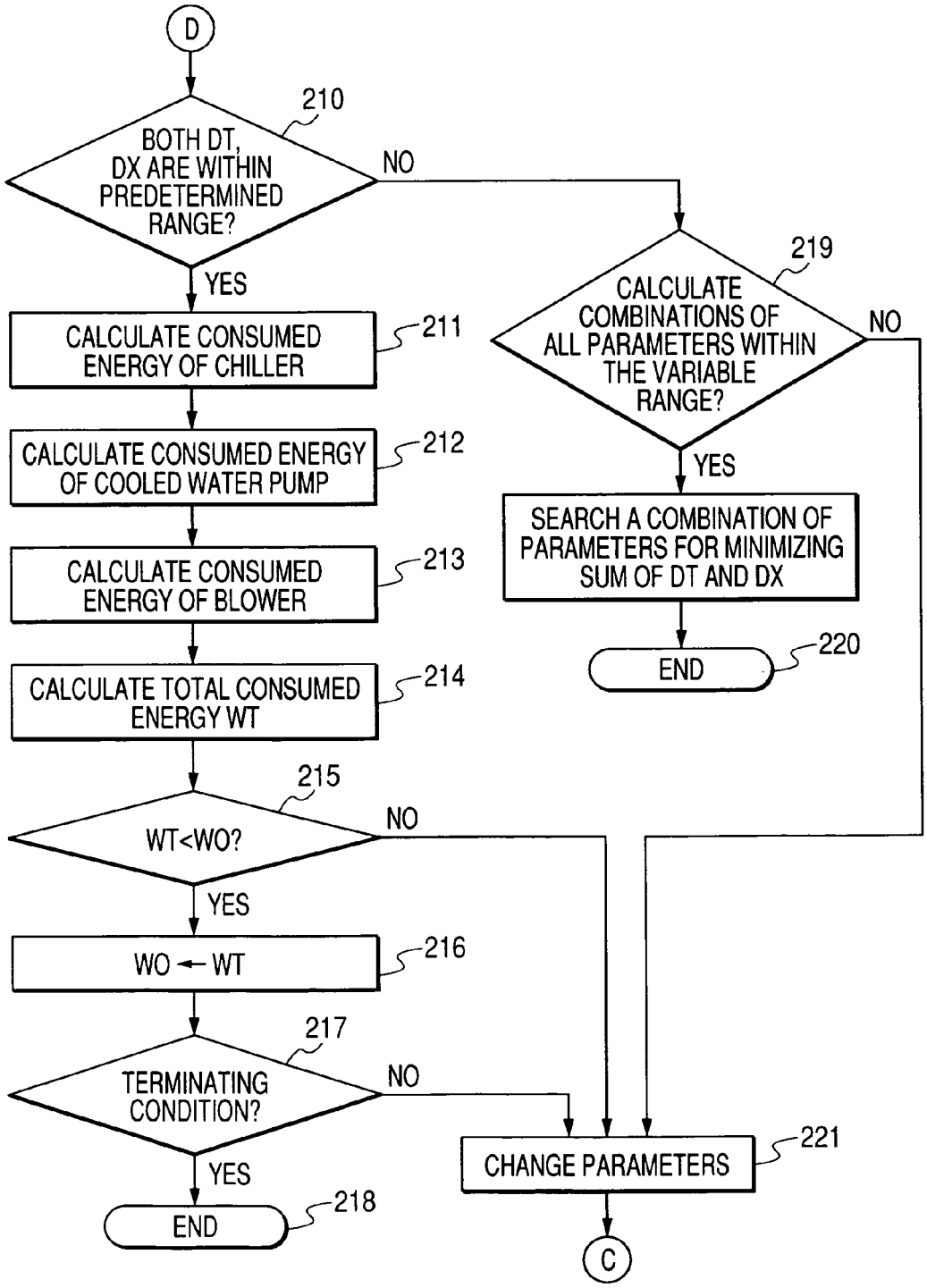
FIG. 5 is a flowchart showing the set point calculation processing sequence.

Here, the sequence for calculating the set points of the chilled water outlet temperature, the chilled water flow rate, and the air flow rate by the arithmetic unit 30 will be explained in detail with reference to FIG. 4 and FIG. 5. FIG. 4 and FIG. 5 are flowcharts for explaining the calculation sequence in the present invention. First, the set point Ts of the indoor temperature and the set point Xs of the indoor humidity are inputted (step 201). Subsequently, the outdoor air temperature TOA and the outdoor air humidity XOA are respectively captured from the outdoor air temperature sensor 11 and the outdoor air humidity sensor 12 (step 202).

Next, initial values WO of the chilled water outlet temperature, the chilled water flow rate, the air flow rate, and the amount of consumed energy of the air-conditioning system as a whole are set (steps 205, 206). As the initial values of the chilled water outlet temperature, the chilled water flow rate, and the air flow rate, the present measured values of the chilled water outlet temperature, the chilled water flow rate and the air flow rate, for example, are used. Moreover, as the initial value of the amount of consumed energy, a total value of the amount of consumed energy under the rated load of the apparatuses forming the air-conditioning system, namely, the chiller 4, chilled water pump 5, and blower 3 is used. Calculate the indoor temperature Tr and the indoor humidity Xr assuming the chilled water outlet temperature, the chilled water flow rate and the air flow rate to be the parameters which are started from these initial values (step 207).

As the calculating method, the method indicated below, for example, may be used. In the structure shown in FIG. 1, expressions for conservations of mass and energy (enthalpy) in regard to the humid air, and an expressions for heat and mass transfer in the cooling coil 2 can be expressed by following equations (NEs) 1 to 17.

$$HOA = CA \cdot TOA + (CV \cdot TOA + L)XOA \ldots \quad (NE1)$$
$$HRA = CA \cdot TRA + (CV \cdot TRA + L)XRA \ldots \quad (NE2)$$
$$HIA = CA \cdot TIA + (CV \cdot TIA + L)XIA \ldots \quad (NE3)$$
$$HSA = CA \cdot TSA + (CV \cdot TSA + L)XSA \ldots \quad (NE4)$$
$$Hwi = CA \cdot TWi + (CV \cdot TWi + L)XWi \ldots \quad (NE5)$$
$$GSA = GOA + GRA \ldots \quad (NE6)$$
$$GSA \cdot HIA = GOA \cdot HOA + GRA \cdot HRA \ldots \quad (NE7)$$
$$GSA \cdot XIA = GOA \cdot XOA + GRA \cdot XRA \ldots \quad (NE8)$$
$$QT = QS + QL \ldots \quad (NE\ 9)$$

-continued $$QS = GSA(HRA - HSA) \ldots \quad (NE10)$$
$$QL = GSA(XRA - XSA)L \ldots \quad (NE11)$$
$$QR = C_{pw} \cdot GW \cdot (TWo - TWi) \ldots \quad (NE12)$$
$$QR = GSA(HIA - HSA) \ldots \quad (NE13)$$
$$QR = GSA(HIA - Hwi) \times EH(GW, GSA, Hwi) \quad (NE14)$$
$$XSA = XIA - (XIA - Xwi) \times EX(GW, GSA, Hwi) \quad (NE15)$$
$$QR = QT + GOA(HOA - HRA) \ldots \quad (NE16)$$
$$GSA(XIA - XSA) = GSA(XRA - XSA) + GOA(XOA - XRA) \quad (NE17)$$

Where, in the equations (Nes) 1 to 17, TOA, XOA, HOA respectively represent the dry bulb temperature, the absolute humidity, and the specific enthalpy of the outdoor air; TRA, XRA, HRA, the wet bulb temperature, the absolute humidity, and the specific enthalpy of the return air; TIA, XIA, HIA, the wet bulb temperature, the absolute humidity, and the specific enthalpy at the entrance of the air-conditioning unit 1; TSA, XSA, HSA, the wet bulb temperature, the absolute humidity, and the specific enthalpy at the exit of the air-conditioning unit 1; TWi, TWo, the chilled water outlet temperature and the chilled water returning temperature of the chiller 4 (or the water temperature at the entrance and exit of the cooling coil 2); XWi, HWi, the absolute humidity and the specific enthalpy of the saturated air of Twi in temperature; QT, QS, QL, the total cooling load, the sensible heat load, and the latent heat load in the room; GOA, GRA, GSA, the flow rates (mass flow rates) of outdoor air, return air and supply air; GW, the chilled water flow rate; and QR, the exchanged heat in the cooling coil 2. Moreover, CA represent the specific heat at constant pressure of the dry air; CV, the specific heat at constant pressure of steam; L, the evaporation latent heat of water; and $C_{pW}$, the specific heat of water.

The NEs 1 to 5 are the equations that calculate the specific enthalpy from the dry bulb temperature and the absolute humidity. NE6 is an equation that expresses the conservation of the flow rate for mixing of outdoor air and circulating air. NEs 7 and 8 are the equations that express the conservations of energy and mass of steam for mixing of the outdoor air and the return air. NEs 9 to 11 are the equations that calculate the heat load and the latent heat load in the room. NE 12 is the equation that calculates the exchanged heat in the cooling coil 12 from the chilled water. NE 13 is the equation that calculates the exchanged heat in the cooling coil 2 from the air. NE 14 is the equation that calculates the exchanged heat in the cooling coil 12 from heat transfer. In this NE, EH represent the enthalpy efficiency of the cooling coil 2. NE 15 is the equation that calculates the changing of absolute humidity in the cooling coil 2. In this NE, EX represent the absolute humidity efficiency of the cooling coil 2. NE 16 indicates that the total cooling load is equal to the sum of the load in the room and the outdoor air processing load. Moreover, NE 17 is the equation that calculates the conservation of steam existing in air of the air-conditioning system as a whole.

In the NE1 to NE17, since changes are very small due to temperature in a specific heat CA at a constant pressure of dry air, a specific heat CV at a constant pressure of steam, water evaporation latent heat L, and a specific heat Cpw of water, these values may be considered as the constant values. Accordingly, the number of variables in the NE1 to NE17 is 24 in total. On the other hand, since the number of equations is 17 in total from NE1 to NE17, the number of variables can be reduced to 7 (seven) which is equal to a difference between 24 and 17. Moreover, when the values captured in Step 202 are used as the outdoor air temperature TOA and the outdoor air humidity XOA, the number of variables becomes 5 (five).

Therefore, the indoor temperature TRA and indoor humidity XRA can be calculated by solving the simultaneous equations from NE1 to NE17 using the chilled water outlet temperature TWi, the chilled water flow rate GW, and the flow rate of the supply air GSA as the three parameters, and the indoor temperature TRA and indoor humidity XRA as two unknown values.

Since the heat transfer coefficient and the mass transfer coefficient in the cooling coil 2 are generally non-linear functions of above variables, the enthalpy coefficient EH of NE14 and the absolute humidity coefficient of NE15 respectively are non-linear functions. That is, since the simultaneous equations of the NE1 to NE17 become the non-linear simultaneous equations, two or more answers, which satisfy combinations of parameters resulting in the identical TRA and XRA may exist in a certain case and on the contrary, and in some cases, no combination of parameters exists.

Therefore, for example, which combination of parameters should be set as the set point is determined by the following method. A difference DT between the calculation result TRA of the indoor temperature obtained by the calculations explained above and the set point Ts thereof, and a difference DX between the calculation result XRA of indoor humidity and the set point Xs thereof are obtained (step 208). Next, whether both the temperature deviation DT and the humidity deviation DX are within the predetermined range or not is determined (step 210). When both DT and DX are within the predetermined ranges, the combination of parameters of the calculation in Step 207 becomes a candidate of the control set point.

Next, a combination of parameters for minimizing the amount of consumed energy of the air conditioning apparatus as a whole in the processes since Step 211 up to Step 214 is obtained, and is set as the control set point. That is, the amount of consumed energy WR of the chiller 4 is calculated from a value of the chilled water outlet temperature and a chilled water flow rate (step 211), the amount of consumed energy WP of the chilled water pump 5 is calculated from a chilled water flow rate (step 212) and the amount of consumed energy WF of the blower 3 is calculated from the air flow rate (step 213) in view of obtaining the total amount of consumed energy WT (step 214). The equations for calculating each amount of consumed energy are preferably given in Step 101 as the functions like the NEs 18 to 20.

| | |
|---|---|
| WR = F1 (TWi, GW, TOA, XOA) . . . | (EN18) |
| WP = F2 (GW) . . . | (NE19) |
| WF = F3 (GSA) . . . | (NE20) |

WT obtained as explained above is compared with W0 (step 215). When WT is smaller than W0, the value of WT is updated to new W0 (step 216). Whether the terminating condition of the calculation is satisfied or not is determined (step 217) and update of parameter is repeated until the terminating condition is satisfied (step 217 and step 221), followed by repetition of the process of Step 207 and subsequent processes. Finally, a combination of parameters for minimizing the total value of the amount of consumed energy is set as the control set point (step 218).

Meanwhile, when at least one of DT and DX is out of the predetermined range, whether calculations are conducted or not for combinations of all parameters in the variable range is determined (step 219). When calculations are not yet executed for all parameters, parameters are changed (step 221) and process in Step 207 and subsequent processes are repeated. However, when a combination of parameters with which DT and DX are within the predetermined range does not exist, a sum of the values attained respectively by multiplying a certain weight to both DT and DX is considered as an error, a combination of parameters for minimizing this error is calculated, and these parameters are set as the control set points (step 220).

The calculation processing sequence explained above, but chilled water temperature cannot be changed at once because of the large thermal capacity of the air conditioning apparatus. So in an actual control, it is preferable to use a local control in addition to the main controlling sequence shown in FIG. 3. That is, because the room temperature greatly depends on the supply air flow rate, and the room humidity depends on the chilled water flow rate greatly though it understands if expression the simultaneous equations of the NE1 to NE17 are solved, it is preferable to infix local controls that the supply air flow rate is controlled so that the room temperature may approach the preset value and the chilled water flow rate is controlled so that the room humidity may approach the preset value.

Change in conditions of humid air in this embodiment will be explained using the humid air diagram illustrated in FIG. 8. In FIG. 8, point A is a state point of the outdoor temperature and humidity; point B, a state point of the target temperature and humidity in the room; point C, a state point of temperature and humidity at the entrance of the air-conditioning unit 1; and point D, a state point of temperature and humidity at the exit of the air-conditioning unit 1. The state point C exists on the segment AB. When the air flow rate is determined, the state point C is fixed and simultaneously a bypass factor BF and a contact factor CF are also fixed. Here, the bypass factor BF is a ratio of the air flowing through the cooling coil 2 without any contact therewith, among the air flowing into the cooling coil 2. The bypass factor BF is a function of the air flow rate and the air side heat transfer coefficient of the cooling coil 2, but since the heat transfer coefficient is a function of the air flow rate, the bypass factor BF becomes, as a result, a function of the air flow rate. Meanwhile, when the chilled water outlet temperature and the chilled water flow rate are fixed, a state point S corresponding to a typical temperature of the heat transfer surface of the cooling coil 2 is also fixed. When the chilled water outlet temperature is high, point S changes toward the high temperature direction on the saturation line in the humid air diagram of FIG. 8. When the chilled water outlet temperature is low, on the contrary, point S changes toward the low temperature direction. Moreover, when the chilled water flow rate is high, even in the case of the same chilled water outlet temperature, a difference in the water temperatures at the entrance and the exit of the cooling coil 2 becomes small, so that the state point S changes toward the low temperature direction. On the contrary, when the chilled water flow rate is low, because the above water temperature difference becomes large, the state point S changes toward the high temperature direction. Therefore, temperature and humidity at the point D dividing the segment SC into BF:1-BF on the segment connecting the state point C and the state point S becomes the result of calculations for temperature and humidity at the exit of the air-conditioning unit 1. In the case where the latent heat load is large, the point S on an extending line CD and the crossing the saturation line may not exist. In this case, no answer exists.

An actual condition of the humid air within the cooling coil 2 is considered to change through a path such as P2 in FIG. 8 because a bypass element and a contact element are mixed. In the path P2, the horizontal line indicates a dry coil and the part other than that indicates a wet coil in which condensation occurs. On the other hand, in the case of the air conditioning apparatus which requires reheating, the humid air in the cooling coil changes, for example, through a path such as P1 in FIG. 8, and thereby the state point of the humid air at the exit of the cooling coil changes to point E. That is, according to this embodiment, since a load of the chiller 4 can be reduced as much as the difference in the specific enthalpy Δh of the state points D and E, the amount of consumed energy can be reduced by that much.

Figure 6:
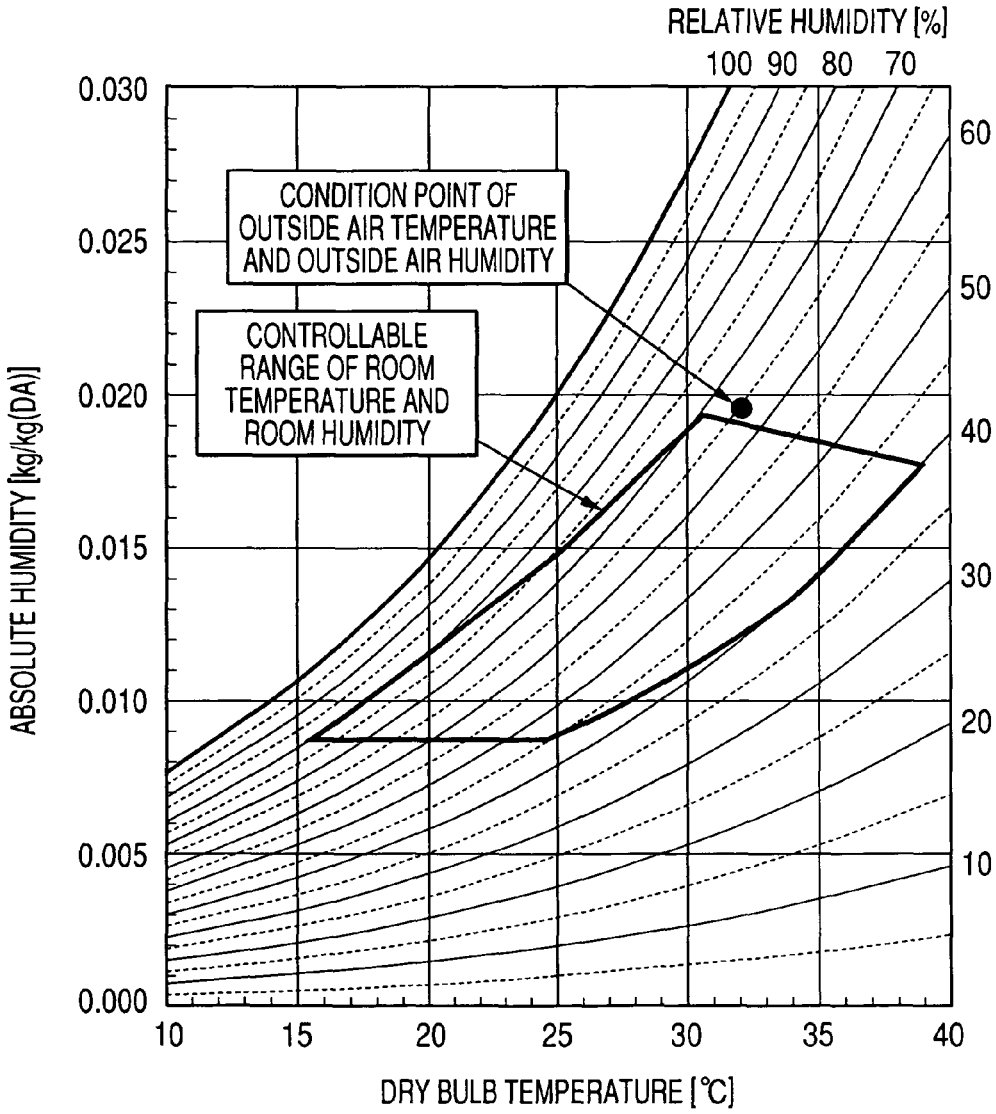
FIG. 6 is a graph showing an embodiment of a temperature and humidity controllable range with one cooling coil.
Figure 7:
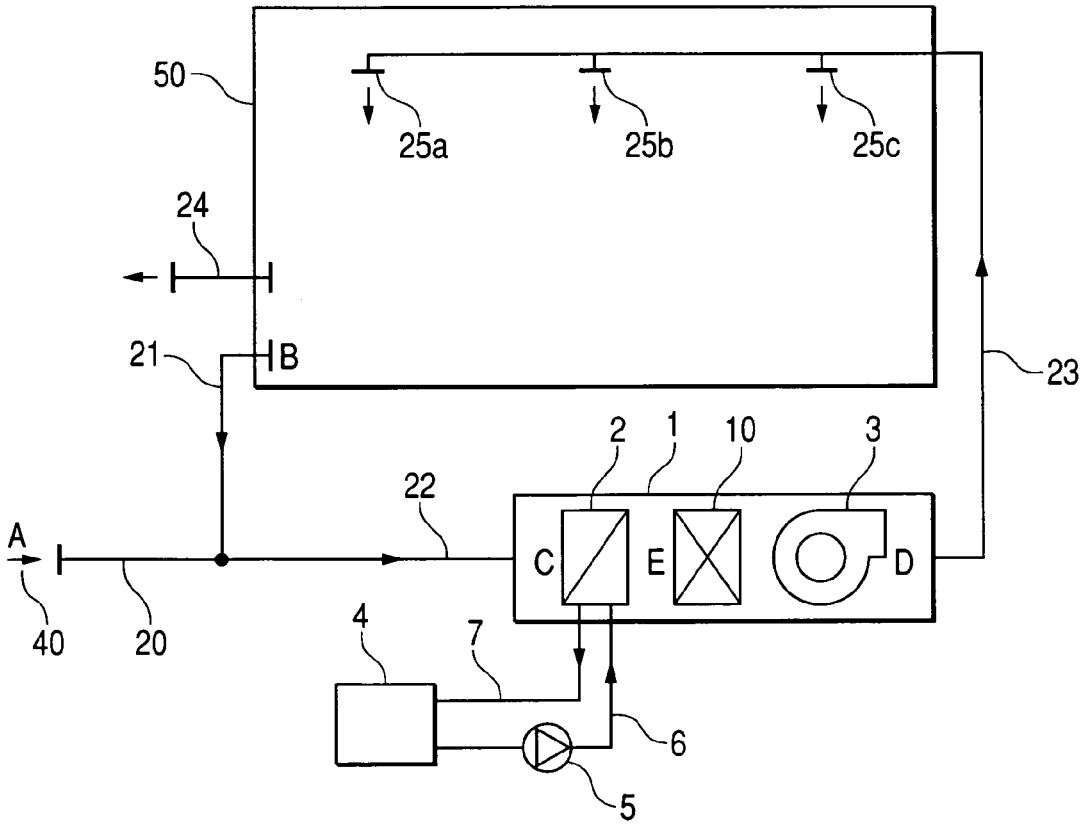
FIG. 7 is a block diagram showing a structure of the air conditioning apparatus of the related art.

An example of the indoor temperature and humidity control under the condition that the first embodiment of the present invention explained above is adapted will be explained with reference to FIG. 6. In FIG. 6, range of the adjustable indoor temperature and humidity under the condition shown in the Table 1 is indicated on the humid air diagram.

TABLE 1

| Item | Numerical Value |
|---|---|
| Room volume | 6000 $m^3$ |
| Flow rate of outdoor air taking | 10000 $m^3$/h (fixed) |
| Outdoor air temperature | 32° C. (fixed) |
| Relative humidity of outdoor air | 65% (fixed) |
| Sensible heat load in the room | 120 kW (fixed) |
| Latent heat load in the room | 30 kW (fixed) |
| Rated power of chiller | 350 kW |
| Chilled water outlet temperature | 7 to 15° C. |
| Chilled water flow rate | 3.5 to 16.8 kg/sec |
| Supply air flow rate | 24000 to 72000 $m^3$/h |

The ambit surrounded by a thick frame illustrated in FIG. 6 indicates the controllable indoor temperature and humidity. Namely, temperature and humidity can be controlled independently within this ambit. This controllable ambit shown in FIG. 6 is extended to a wider range including a temperature and humidity ambit that person feels comfortable, respectively ranged in general as 25 to 26° C. in temperature and 50 to 60% in humidity. Therefore, the air conditioning apparatus of the present invention is capable of independently controlling both indoor temperature and humidity in a wider range and also controlling the indoor temperature and humidity condition which is comfortable for a person.

The controllable ambit shown in FIG. 6 will change in accordance with a structure of the air conditioning apparatus and the conditions shown in the Table 1, and is never limited only to the first embodiment.

Second Embodiment

Figure 9:
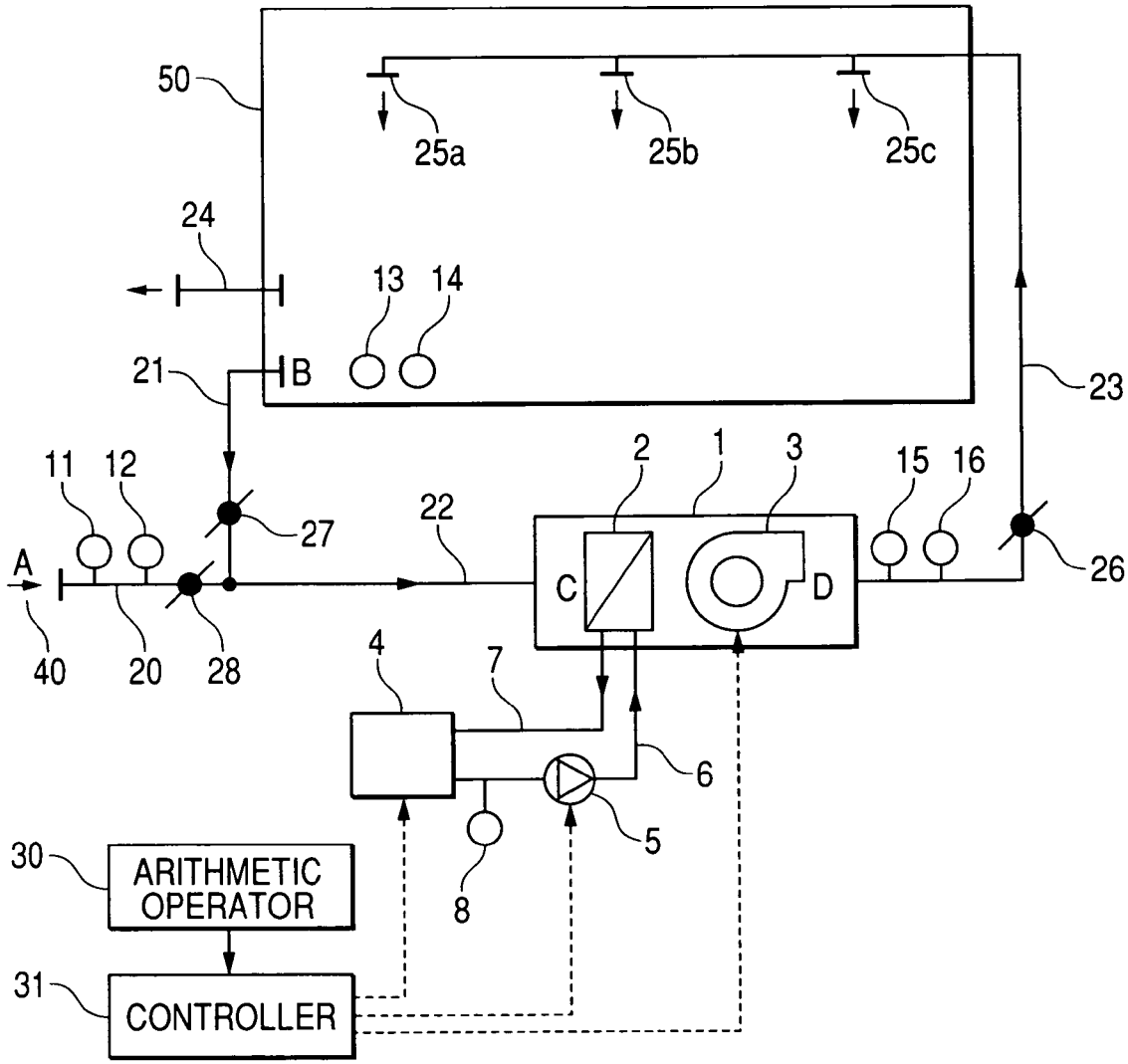
FIG. 9 is a block diagram showing a structure of the air conditioning apparatus.
Figure 10:
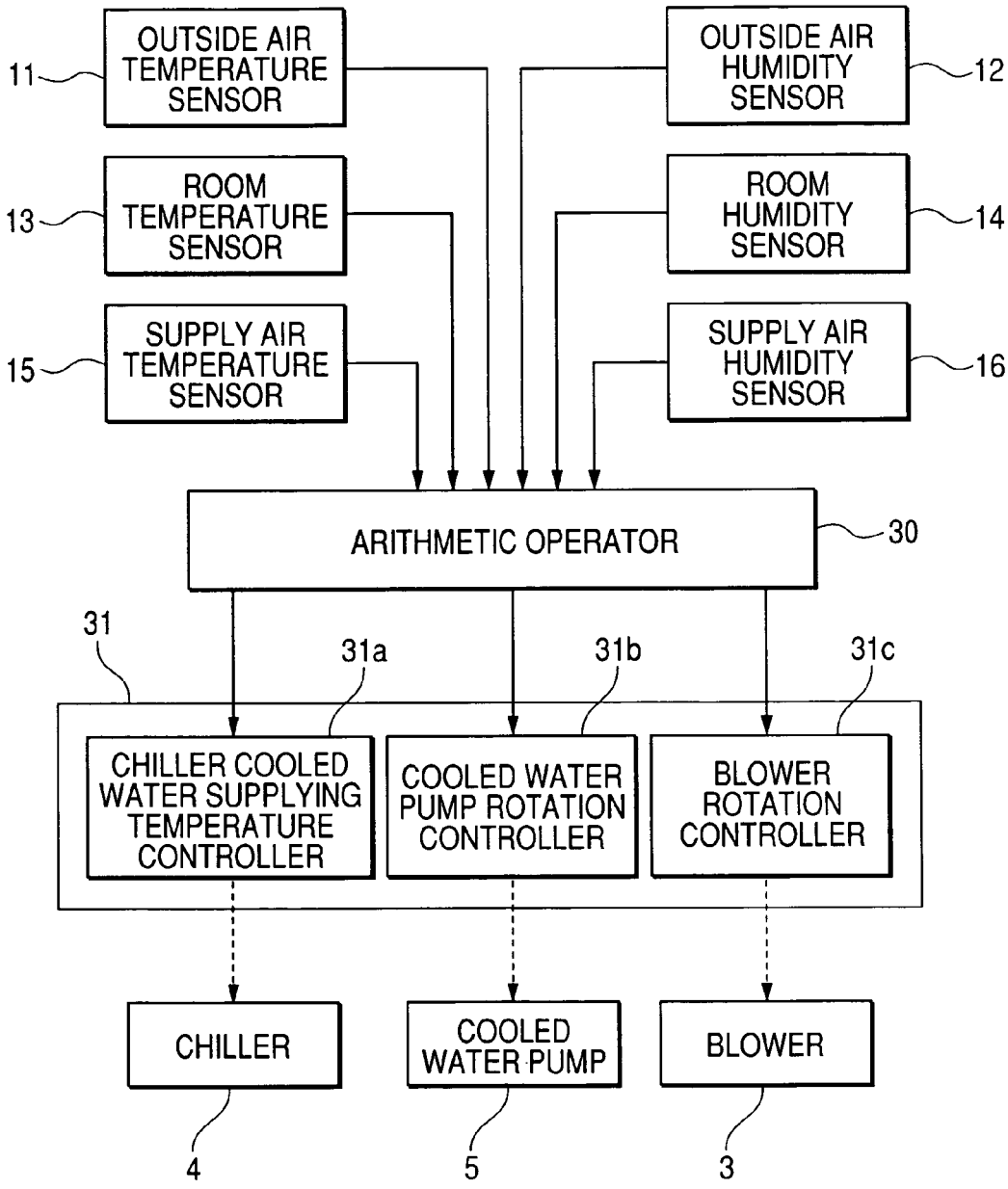
FIG. 10 is a control block diagram of the air conditioning apparatus.
Figure 11:
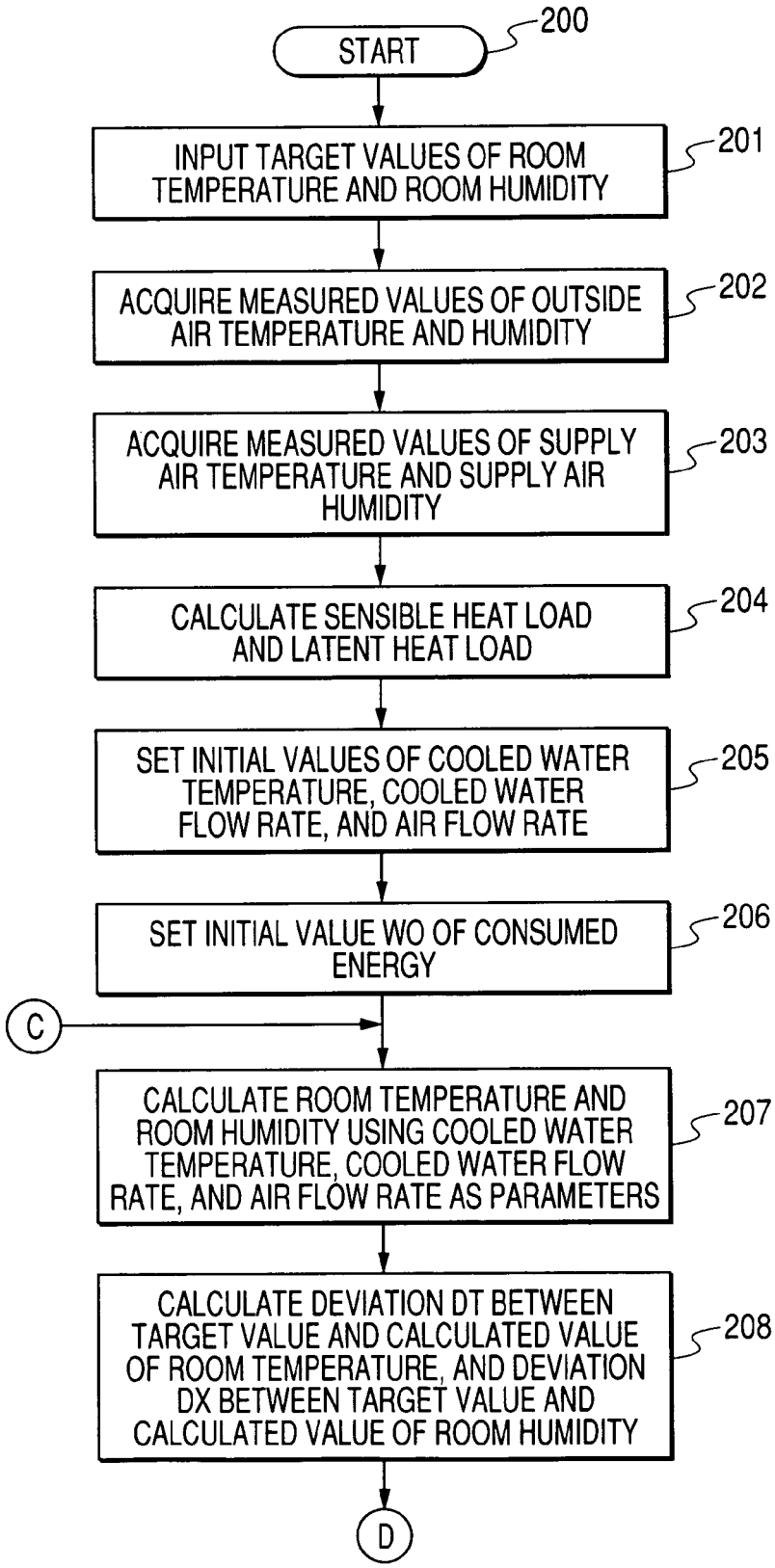
FIG. 11 is a flowchart showing the set point calculation processing sequence.

A second embodiment according to an aspect of the present invention will be explained with reference to FIGS. 9 to 11. FIG. 9 is a block diagram showing a structure of the air conditioning apparatus for explaining the second embodiment of the present invention. FIG. 10 is a block diagram for explaining the second embodiment of the present invention. Moreover, FIG. 11 is a flowchart for explaining the operations of an arithmetic unit in the second embodiment of the present invention.

In the embodiment illustrated in FIG. 9, the difference from the first embodiment of FIG. 1 is that a supply air temperature sensor 15 for measuring the temperature of air at the exit of the air-conditioning unit 1 and a supply air humidity sensor 16 for measuring the humidity of air at the exit of the air-conditioning unit 1 are provided, and the other structure is identical to that of FIG. 1. In the embodiment of FIG. 10, the difference from the first embodiment of FIG. 2 is that the arithmetic unit 30 is constituted to capture the measured values of the supply air temperature and the supply air humidity, and the other structure is identical to that of FIG. 2. Moreover, in the operation flowchart of FIG. 11, the difference from that of FIG. 4 is that Step 203 for acquiring the measured values of the supply air temperature and the supply air humidity, and Step 204 for calculating sensible heat load and latent heat load are added and the other calculation sequence is identical to that of FIG. 4.

In the second embodiment, the present indoor temperature TRA and the present indoor humidity XRA are captured respectively by the indoor temperature sensor 13 and indoor humidity sensor 14 and moreover the present supply air temperature TSA and the present supply air humidity XSA are captured respectively by the supply air temperature sensor 15 and the supply air humidity sensor 16. Thereby, the sensible heat load and the latent heat load in the room can be calculated by the method explained below using these data.

In the humid air diagram of FIG. 8, when the present state points of air in the room and at the exit of the air-conditioning unit 1 are defined as points b and d, inclination of the segment bd connecting the state points b and d corresponds, as explained above, a ratio of the sensible heat load and the latent heat load. Moreover, since a difference in enthalpies of the state points b and d is identical to total load, the sensible heat load and latent heat load can be calculated from these quantities of states at b and d. First, the specific enthalpies HRA and HSA at the state points b and d are respectively calculated from the NE2 and NE4. Next, the specific enthalpy Hf at the state point f where temperature is equal to the temperature TRA of the state point b and absolute humidity is equal to the absolute humidity XSA of the state point d is calculated from an NE21. From these calculation results, the sensible heat load QS and the latent heat load QL can respectively be obtained from NE22 and NE23. In the NE22 and NE23, the sensible heat load QS and latent heat load QL are multiplied by the supply air flow rate GSA in order to change the unit of QS and QL to the unit of energy. However, such multiplication is unnecessary when it is required only to know the ratio of the sensible heat load QS to the latent heat load QL.

$$Hf = CA \cdot TRA + (CV \cdot TRA + L)XSA \quad \text{(NE21)}$$
$$QS = GSA(Hf - HSA) \quad \text{(NE22)}$$
$$QL = GSA(HRA - Hf) \quad \text{(NE23)}$$

On the other hand, when change of the air-conditioning load is small, the ratio of the sensible heat load to the latent heat load can be considered as identical before and after the calculation. Namely, the sensible heat load QS and latent heat load QL may be considered as the constants in the calculation, and the number of equations and the number of unknown values can respectively be reduced by two in the group of equations of NE1 to NE17 in the first embodiment, and thereby, the amount of calculation processes can also be reduced. The calculation sequence of Step 208 and the subsequent steps in FIG. 11 is identical, for example, to that in the flowchart of FIG. 5.

In the first and the second embodiments explained above, the air flow rate has been adjusted by controlling frequency of the blower 3. However, the air flow rate can also be adjusted by at least one opening of the return air damper 27, the outdoor air intake damper 28 and the supply air damper 26. In this case, the controller 31 transmits a control command to each damper in view of adjusting the air flow rate by controlling the opening of the damper.

Moreover, the chilled water flow rate may also be adjusted by controlling an opening of a valve provided to the pipe connecting the chiller 4 to the cooling coil 2.

In addition, it is also naturally possible that when the change in the air-conditioning load and set points of indoor temperature and humidity is small, the calculation result of the arithmetic unit 30 is displayed on a terminal apparatus not illustrated, and for example, the chilled water outlet temperature of the chiller 4, number of rotations of the chilled water pump 5, and frequency of the blower 3 can be adjusted manually on the basis of the display result.

Moreover, a plurality of air-conditioning units may be provided. It is also possible to form a structure to supply the air into a plurality of rooms with only one air-conditioning unit.

Moreover, in the first embodiment and the second embodiment explained above, the air-conditioning unit 1 includes only the cooling coil 2 as the heat exchanger, but another heat exchanger, such as the reheating coil, for example, may be provided. Even in this case, since it is enough to use only the cooling coil 2 for heat exchange during air-conditioning, the temperature and the humidity of air is identical in the front and back of the reheating coil even when the reheating coil, for example, is provided. In addition, the temperature difference in the temperature and the heat source side for heat exchange with air is reduced, and thereby, consumption of energy required for reheating can also be reduced to zero.

What is claimed is:

1. An air conditioning apparatus comprising:

an air-conditioning unit including a cooling coil as a heat exchanger;

a blower;

a chiller; and a coolant pump, wherein the air-conditioning unit is configured so that the coolant pump pumps the coolant cooled by the chiller to the cooling coil, and the cooling coil cools the air through heat exchange between the coolant and the air, and the cooled air is supplied into a room by the blower for air-conditioning purposes, wherein the air-conditioning unit comprises only the cooling coil as the heat exchanger, and the air conditioning apparatus further comprises a controller for adjusting a ratio of a dry coil part and wet coil part of the cooling coil by controlling the coolant temperature of the chiller, the coolant flow rate of the coolant pump, and the air flow rate of the blower in accordance with a ratio of the sensible heat load and the latent heat load in the room.

2. An air conditioning apparatus comprising:

an air-conditioning unit including at least a cooling coil as a heat exchanger;

a blower;

a chiller; and a coolant pump, wherein the air-conditioning unit is configured so that the coolant pump pumps the coolant cooled by the chiller to the cooling coil, and the cooling coil cools the air through heat exchange between the coolant and the air, and the cooled air is supplied into the room by the blower for air-conditioning, wherein the air-conditioning unit executes heat exchange only by the cooling coil during the cooling operation, and the air conditioning apparatus further comprises a controller for adjusting a ratio of a dry coil part and wet coil part of the cooling coil by controlling the coolant temperature of the chiller, the coolant flow rate of the coolant pump, and the air flow rate of the cooled air of the blower in accordance with a ratio of the sensible heat load and the latent heat load in the room.

3. The air conditioning apparatus according to any one of claims 1 and 2, comprising:

an outdoor air temperature sensor for measuring dry-bulb temperature of the outdoor air;

an outdoor air humidity sensor for measuring humidity of the outdoor air;

a indoor temperature sensor for measuring dry-bulb temperature of the air in the room;

a indoor humidity sensor for measuring humidity of the air in the room, an arithmetic unit; and a controller, wherein the arithmetic unit calculates each set point of the coolant temperature of the chiller, the coolant flow rate of the coolant pump, and the air flow rate of the blower in order to respectively set, within the predetermined range, a difference between the measured value of the indoor temperature sensor and the preset indoor temperature, and a difference between the measured value of the indoor humidity sensor and the preset indoor humidity, and the controller controls the coolant temperature of the chiller, the coolant flow rate of the coolant pump, and the air flow rate of the blower on the basis of the arithmetic calculation result of the arithmetic unit.

4. The air conditioning apparatus according to claim 3, wherein the arithmetic calculation result of the arithmetic unit is displayed on a terminal apparatus, and the coolant temperature of the chiller, the coolant flow rate of the coolant pump, and the air flow rate of the blower are controlled on the basis of the information displayed on the terminal apparatus.

5. The air conditioning apparatus according to claim 3, wherein the arithmetic unit comprises an operator to calculate the amount of consumed energy of the air conditioning apparatus, and the arithmetic unit calculates and outputs a combination of each set point for minimizing the amount of consumed energy of the air conditioning apparatus among the combinations of the coolant temperature of the chiller, the coolant flow rate of the coolant pump, and the air flow rate of the blower to respectively set, within the predetermined range, a difference between the measured value of the indoor temperature sensor and the preset indoor temperature, and a difference between the measured value of the indoor humidity sensor and the preset indoor humidity.

6. The air conditioning apparatus according to claim 3, wherein the outdoor air humidity sensor and the indoor humidity sensor respectively measure any one of relative humidity, absolute humidity, dew point temperature, and wet bulb temperature of air.

7. The air conditioning apparatus according to claim 3, wherein the controller has two logic sequences;

one is centrally controlling the coolant temperature of the chiller, the coolant flow rate of the coolant pump, and the air flow rate of the blower on the basis of the arithmetic calculation result of the arithmetic unit, another is controlling the coolant flow rate of the coolant pump locally so that the room humidity may approach the preset value and controlling the air flow rate of the blower locally so that the room temperature may approach the preset value.

8. The air conditioning apparatus according to claim 7, wherein a time interval of the local controlling is substantially real-time and a time interval of the central controlling is longer than that of the local controlling according with a thermal capacity of the air conditioning apparatus.

9. An air conditioning apparatus for conducting air-conditioning by heat exchanging a coolant which is cooled by a chiller and pumped by a coolant pump, and air in a cooling coil, and supplying the cooled air to a room by a blower, wherein the air conditioning apparatus comprises a controller for adjusting a ratio of a dry coil part and wet coil part of the cooling coil by controlling the coolant temperature of the chiller, the coolant flow rate of the coolant pump, and the air flow rate of the blower in accordance with a rate of the sensible heat load and the latent heat load in the room.

10. The air conditioning apparatus according to claim 9, comprising:

an outdoor air temperature sensor for measuring dry-bulb temperature of the outdoor air;

an outdoor air humidity sensor for measuring humidity of the outdoor air;

a indoor temperature sensor for measuring dry-bulb temperature of the air in the room;

a indoor humidity sensor for measuring humidity of the air in the room;

a supply air temperature sensor for measuring dry-bulb temperature of the air at the exit of the air-conditioning unit;

a supply air humidity sensor for measuring humidity of the air at the exit of the air-conditioning unit;

an arithmetic unit; and a controller, wherein the arithmetic unit calculates the sensible heat load and the latent heat load from each measured value of the indoor temperature sensor, the indoor humidity sensor, the supply air temperature sensor, and the supply air humidity sensor, and also calculates each set point of the coolant temperature of the chiller, the coolant flow rate of the coolant pump, and the air flow rate of the blower in order to respectively set, within the predetermined range, a difference between the measured value of the indoor temperature sensor and the preset indoor temperature, and a difference between the measured value of the indoor humidity sensor and the preset indoor humidity, while the controller controls the coolant temperature of the chiller, the coolant flow rate of the coolant pump, and the air flow rate of the blower on the basis of the arithmetic calculation result of the arithmetic unit.

11. The air conditioning apparatus according to claim 10, wherein the outdoor air humidity sensor, the indoor humidity sensor, and the supply air humidity sensor respectively measure any one of relative humidity, absolute humidity, dew point temperature, and wet bulb temperature of air.

12. The air conditioning apparatus according to any one of claims 2 and 9, wherein the air flow rate of the blower is adjusted by controlling at least one of: the opening of an return air damper provided at a duct for guiding the return air from the room into the air-conditioning unit; the opening of an outdoor air damper provided at a duct for taking in the outdoor air and then guiding the air to the air-conditioning unit; the opening of a supply-air duct provided at a duct for guiding the air cooled by the cooling air into the room; and frequency of the blower.

13. The air conditioning apparatus according to any one of claims 1, 2 and 9, wherein the coolant flow rate is adjusted by controlling at least one of: the opening of a valve provided to a pipe for connecting the chiller to the cooling coil; and frequency of the coolant pump.

* * * * *